United States Patent [19]

Kussel et al.

[11] Patent Number: 4,622,998

[45] Date of Patent: Nov. 18, 1986

[54] HYDRAULIC CONTROL DEVICE

[75] Inventors: Willy Kussel, Werne; Bayramali Demircan, Bergkamen-Rünthe, both of Fed. Rep. of Germany

[73] Assignee: Gewerkschaft Eisenhutte Westfalia, Lunen, Fed. Rep. of Germany

[21] Appl. No.: 766,351

[22] Filed: Aug. 16, 1985

[30] Foreign Application Priority Data

Sep. 29, 1984 [DE] Fed. Rep. of Germany ..... 3435952

[51] Int. Cl.[4] ..... F15B 13/06

[52] U.S. Cl. ..... 137/596.15; 91/524; 91/529; 91/531; 137/596.16; 405/302

[58] Field of Search ..... 91/522, 524, 529, 531, 91/536; 137/596.15, 596.16, 625.11; 405/302

[56] References Cited

U.S. PATENT DOCUMENTS

| | | | |
|---|---|---|---|
| 1,199,640 | 9/1916 | Vincent | 91/536 X |
| 3,500,719 | 3/1970 | Rieschel | 91/524 X |
| 3,967,534 | 7/1976 | Cryder et al. | 91/524 X |

*Primary Examiner*—Gerald A. Michalsky

*Attorney, Agent, or Firm*—Maurice E. Gauthier

[57] ABSTRACT

A hydraulic control device is incorporated in a hydraulic control system for a mine roof support assembly. The hydraulic control system includes a plurality of hydraulic control valves which are controlled by the hydraulic control device. The hydraulic control device is constituted by a longitudinal slide valve having a slide member longitudinally reciprocable in a slide valve housing. A rotary drive is provided for moving the slide member within the slide valve housing. The slide member is provided with two axial bores each of which opens into a respective pair of axially-spaced radial bores which terminate at the peripheral surface of the slide member. A first radial bore of each axial bore opens into a respective annular groove formed in the slide valve housing. The second radial bore of each axial bore is connected to a respective group of control ports provided on the slide valve housing. The control ports of each group are axially spaced, and are connected to the hydraulic control valves by respective hydraulic control lines.

20 Claims, 1 Drawing Figure

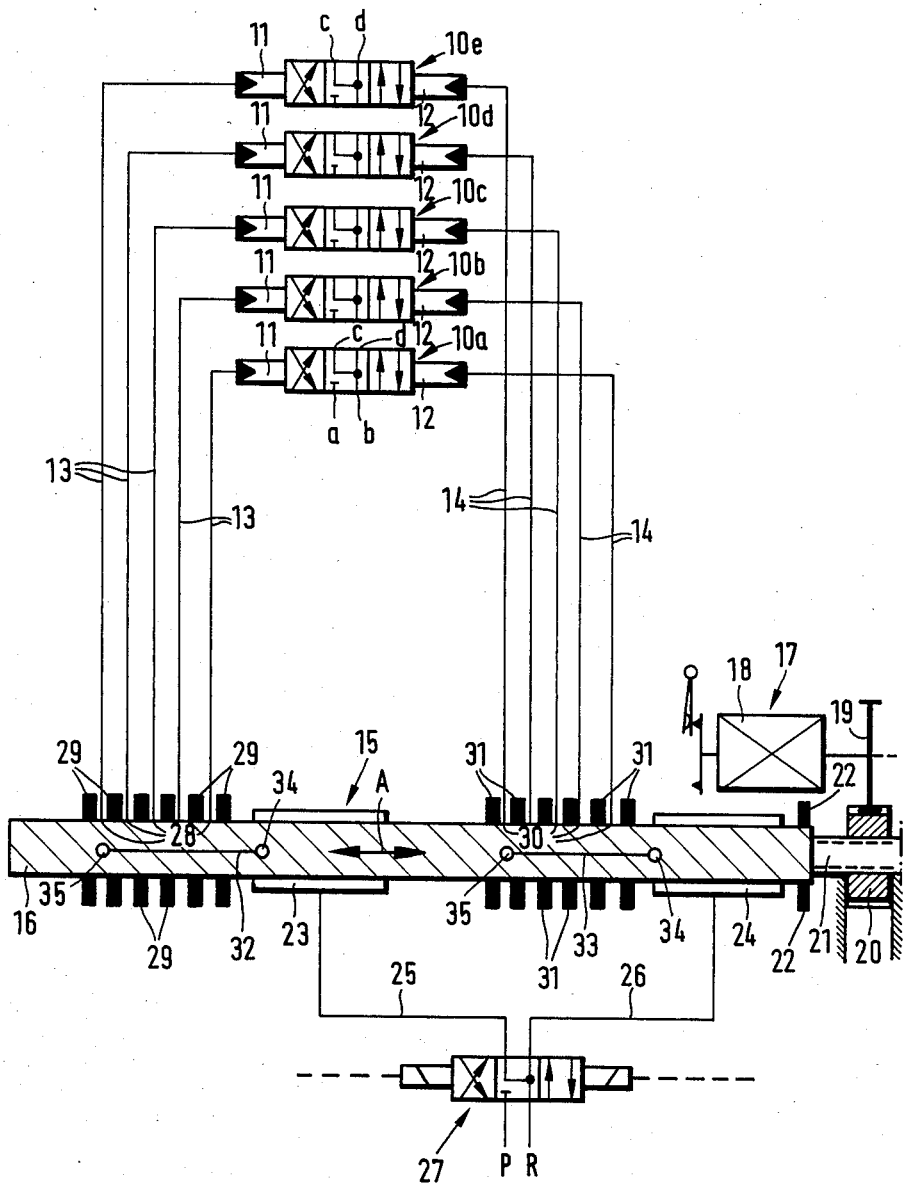
11
c
d
10e
12
10d
10c
10b
10a
a
b
13
14
15
A
16
17
18
19
20
21
22
23
24
25
26
27
28
29
30
31
32
33
34
35
P
R

HYDRAULIC CONTROL DEVICE

BACKGROUND TO THE INVENTION

This invention relates to a hydraulic control device for incorporation in a hydraulic control system for a mine roof support assembly.

A known hydraulic control system (see U.S. Pat. No. 3,821,880) has a rotary slide valve which controls a group of hydraulically-actuatable directional control valves, each of which is allocated to a respective hydraulic ram of the time roof support units, the working chambers of the rams being connected to the output sides of the directional control valves. The input side of the rotary slide valve is connected to hydraulic pressure and return lines; and its output side is connected, via hydraulic control lines, to the directional control valves. This type of control system, with its manually-operable slide valve, is intended for manual control, or for combined manual and automatic control.

In the course of the further development and automation of control systems of this type, electrohydraulic control systems have become known (see U.S. Pat. No. 4,378,027), in which, in place of the rotary slide valve, a magnetic valve is used as a pre-control valve. Such a magnetic valve is actuatable electrically from a central control position, or by a electronic control system associated with the roof support assembly. In this way, it is possible to control the various working actions of the assembly such as prop robbing and setting, conveyor and roof support advance etc. Such a control system, when used in a modern support assembly, requires a relatively large number of magnetic valves, and this results in an expensive system.

The aim of the invention is to provide a hydraulic control device for incorporation in a hydraulic control system for a mine roof support assembly, which device avoids the high expense resulting from the use of a costly rotary slide valve or from a plurality of costly magnetic valves.

SUMMARY OF THE INVENTION

The present invention provides a hydraulic control device for incorporation in a hydraulic control system for a mine roof support assembly, the hydraulic control system including a plurality of hydraulic control valves which are controlled by the hydraulic control device, the hydraulic control device being constituted by a longitudinal slide valve having a slide member longitudinally reciprocable in a slide valve housing, and a drive for moving the slide member within the slide valve housing, wherein the slide member is provided with at least one axial bore, the or each axial bore opening into a respective pair of axially-spaced radial bores which terminate at the peripheral surface of the slide member, a first radial bore of the or each axial bore opening into a respective annular groove formed in the slide valve housing, and the second radial bore of the or each axial bore being connected to a respective group of control ports provided on the slide valve housing, the control ports of the or each group being axially spaced, and the control ports of the or each group being connectible to the hydraulic control valves by respective hydraulic control lines.

Thus, according to the invention, a simple longitudinal slide valve replaces the expensive rotary slide valve usual in manual control systems, or the magnetic valve groups required in electrohydraulic control systems.

The hydraulic control valves, which are allocated to individual hydraulic rams, can be actuated hydraulically via the slide valve.

In order to move the slide member, a simple electric, hydraulic, pneumatic or even small mechanical drive can be used. Advantageously, however, a rotary drive constitutes the drive means. In the case of manual control, the drive means can be controlled manually; while, in the case of an electrohydraulic support control system, the drive means can be effected electrically or hydraulically. Preferably, the drive means reciprocably drives the slide member via a threaded spindle, and the slide member is non-rotatably mounted within the slide valve housing.

In a preferred embodiment, the length of the or each annular groove and the length of the or each axial bore is at least equal to the distance through which the slide member is movable by the drive means.

On the slide valve housing, the hydraulic control lines leading to the control ports of the or each group may be arranged side-by-side at the closest possible. intervals, seals being provided between the hydraulic control lines.

The invention also provides a hydraulic control system for a mine roof support assembly, the hydraulic control system comprising a hydraulic control device and a plurality of hydraulic control valves, the hydraulic control valves being controlled by the hydraulic control device, wherein the hydraulic control device is as defined above, and wherein the control ports of the or each group are connected to the hydraulic control valves by respective hydraulic control lines.

Advantageously, the control system further comprises an additional hydraulic control valve, a hydraulic pressure line and a hydraulic return line, the additional hydraulic control valve being connected between the hydraulic pressure and return lines and the longitudinal slide valve. Because the hydraulic connection of the individual control ports of the slide valve to the hydraulic pressure return lines takes place through the axial bore(s) and the radial bores branching therefrom, in combination with the annular groove(s) in the slide valve housing, a simple and reliable configuration of the slide valve results, even where a relatively large number of hydraulic control valves must be actuated by the slide valve. At the same time, relatively short shift distances of the slide valve result, and the latter can, therefore, also have relatively small dimensions.

Preferably, the additional hydraulic control valve is an electromagnetically-operated hydraulic control valve, and is hydraulically connected to the or each annular groove of the slide valve housing. The additional hydraulic control valve may be a 4/3 way hydraulic control valve, or may be constituted by two 3/2 way hydraulic control valves.

In a preferred embodiment, the slide valve housing has two annular grooves, and the slide member has two axially-spaced axial bores, each of the annular grooves being connected to a respective output port of the additional hydraulic control valve, and each of the axial bores being connected, via its first radial bore, to the associated annular groove, and, via its second radial bore to the associated group of control ports.

Advantageously, each of the hydraulic control valves is a double-acting control valve which is actuatable in opposite directions by means of respective control cylinders.

The provision of the additional hydraulic control valve permits a simplification of construction of the slide valve, especially when through it the hydraulic control cylinders of the hydraulic control valves are not only pressurisable, but also capable of depressurisation by connection to the return line.

Preferably, the hydraulic control lines associated with one group of control ports are connected to the first control cylinders, and the hydraulic control lines associated with the other group of control ports are connected to the second control cylinders, whereby each hydraulic control valve can be extended by connecting the associated first control cylinder to the hydraulic pressure line and the associated second control cylinder to the hydraulic return line, and each hydraulic control valve can be retracted by connecting the associated first control cylinder to the hydraulic return line and the associated second control cylinder to the hydraulic pressure line.

This arrangement permits reliable actuation of a group of hydraulic control valves serving for pressure loading and relief of double-acting rams, with the aid of a relatively simple, small slide valve, the change in the direction of pressure loading of the hydraulic control valves being effected by the change-over of the additional hydraulic control valve.

BRIEF DESCRIPTION OF THE DRAWING

A hydraulic control device constructed in accordance with the invention will now be described, by way of example, with reference to the accompanying drawing, the single FIGURE of which is a schematic diagram of a hydraulic control system incorporating the hydraulic control device.

DESCRIPTION OF PREFERRED EMBODIMENT

Referring to the drawing, a hydraulic control system for a mine roof support assembly comprises a group of 4/3 directional control valves 10*a*, 10*b*, 10*c*, 10*d* and 10*e*. The input side of each of these directional control valves 10*a* to 10*e* is connected, via a port a, to a hydraulic high pressure line P; and, via a port b, to a hydraulic return line R. Each directional control valve 10*a* to 10*e* has two output ports which are connected to the two working chambers of a respective hydraulic ram (not shown). Each directional control valve 10*a* to 10*e* is associated with its own double-acting hydraulic ram, or with its own group of double-acting hydraulic rams, which can, therefore, be extended or retracted by appropriate actuation of the associated directional control valves.

The directional control valves 10*a* to 10*e* are hydraulically actuatable in both control directions by means of control cylinders 11 and 12. The control cylinders 11 are connected to hydraulic actuating lines 13, and the control cylinders 12 are connected to hydraulic actuating lines 14. When the control cylinders 11 are supplied with pressurised hydraulic fluid via the actuating lines 13, the directional control valves 10*a* to 10*e* are changed over in the one direction; and when the control cylinders 12 are supplied with pressurised hydraulic fluid via the actuating lines 14, they are changed over in the opposite direction. Thus, in the first case, the hydraulic rams associated with the directional control valves 10*a* to 10*e* are retracted; and, in the second case, these rams are extended.

The directional control valves 10*a* to 10*e* are controlled by a hydraulic control device constituted by a longitudinal slide valve 15, of which essentially only the slide member 16 (which is axially displaceable in the direction of the double arrow A), but not its slide valve housing, is shown in the drawing. The positioning of the slide member 16 is accomplished by means of a rotary drive 17. Alternatively, an electric, hydraulic, pneumatic or even mechanical drive can be provided instead of the rotary drive. The rotary drive 17 includes a small stepping motor 18, which drives a spindle 21 through gear wheels 19 and 20. The spindle 21 is screwed into a threaded bore at the end of the slide member 16. The slide member 16 is secured against rotation in the slide valve housing by tongue-and-groove guides 22. At the same time, the tongue-and-groove guides permit axial movement of the slide member 16 in the direction of the arrow A.

Of the housing of the longitudinal slide valve 15, only two axially-spaced grooves 23 and 24 are shown in the drawing. The grooves 23 and 24 are connected, via respective hydraulic lines 25 and 26, to two outlet ports of a 4/3 way hydraulic control valve 27. The input side of the hydraulic control valve 27 is connected to the hydraulic pressure line P and to the hydraulic return line R. The hydraulic control valve 27 is an electromagnetically-operated directional control valve. Instead of using a 4/3 way directional control valve, the valve 27 could be constituted by two 3/2 way directional control valves. The essential point is that, by changing over of the hydraulic control valve 27, it is possible either to connect the annular groove 23 to the pressure line P and the annular groove 24 to the return line R, or to connect the annular groove 24 to the pressure line P and the annular groove 23 to the return line R. In the neutral position shown in the drawing, both annular grooves 23 and 24 are connected to the return line R.

The actuating lines 13 of the directional control valves 10*a* to 10*e* are connected, closely side-by-side, to control ports 28 on the slide valve housing. Seals 29 are provided between the control ports 28 to seal off the control ports from one another on the slide valve housing. Similarly, the actuating lines 14 are connected, closely side-by-side, to control ports 30 on the slide valve housing. Seals 31 are provided between the control ports 30. The control ports 28 and 30 may be constituted by simple bores in the slide valve housing.

This slide member 16 of the longitudinal slide valve 15 is provided with two axially-spaced axial bores 32 and 33. Each of the bores 32 and 33 opens into respective radial bores 34 and 35 at its two ends. The radial bores 34 open into the annular grooves 23 and 24, while the radial bores 35 open to the circumference of the slide member 16, thereby constituting the connections to the actuating lines 13 and 14. Thus, the actuating lines 13 are hydraulically actuated via the annular groove 23 and the axial bore 32 and its associated radial bores 34 and 35; while the actuating lines 14 are hydraulically actuated via the annular groove 24 and the axial bore 33 and its associated radial bores 34 and 35.

In the illustrated position, the two axial bores 32 and 33 are connected, via the radial bores 35, to the actuating lines 13 and 14 which lead to the control cylinders 11 and 12 of the directional control valve 10*e*. The control cylinders 11 and 12 are, in this case, unpressurised, since the control valve 27 is in its neutral position, in which the two lines 25 and 26 (and thus the two annular grooves 23 and 24) are connected to the return line R. If the control valve 27 is changed over, so that the annular groove 23 is connected, via the line 25, to the pressure line P; and the annular groove 24 is connected, via the line 26, to the return line R; then the associated actuating line 13 will be supplied with pressurised hydraulic fluid via the longitudinal slide valve 15. Consequently, the directional control valve 10*e* will be changed over by pressurisation of its control cylinder 11, so that the associated hydraulic ram is retracted. In order to extend this hydraulic ram, the control valve 27 is changed over into the position in which the annular groove 24 is connected to the hydraulic pressure line P, and the annular groove 23 is connected to the hydraulic return line R. Accordingly, the control cylinder 12 of the directional control valve 10*e* will be pressurised, and the control cylinder 11 will be depressurised, so that the directional control valve 10*e* is shifted into its other control position, and the associated ram is extended.

It can be seen that, via the axial bores 32 and 33, the control ports 28 and 30 (and thus the directional control valves 10*a* to 10*e*) can be actuated individually. In each case, a given control cylinder 11 (or 12) of the actuated directional control valve is connected to the pressure line P, and the other control cylinder 12 (or 11) of this directional control valve is connected to the return line R. Moreover, the direction of action is reversible by changeover of the control valve 27.

It will be understood that the axial bores 32 and 33 each have such a length that the connection to the associated annular groove 23 or 24 is maintained through the radial bores 34 in every control position of the longitudinal slide valve 15. The length of the annular grooves 23 and 24 is, therefore, at least equal to the distance through which the slide member 16 moves, or the distance occupied by the control ports 28 and 30 of the two groups.

We claim:

1. A hydraulic control device for incorporation in a hydraulic control system for a mine roof support assembly, the hydraulic control system including a plurality of hydraulic control valves which are controlled by the hydraulic control device, the hydraulic control device comprising a longitudinal slide valve having a slide member longitudinally reciprocable in a slide valve housing, and a drive for moving the slide member within the slide valve housing, wherein the slide member is provided with two axially-spaced axial bores, each axial bore opening into a respective pair of axially-spaced radial bores which terminate at the peripheral surface of the slide member, a first radial bore of each axial bore opening into a respective annular groove formed in the slide valve housing, and the second radial bore of each axial bore being connected to a respective group of control ports provided on the slide valve housing, the control ports of each group being axially spaced, and the control ports of each group being connected to the hydraulic control valves by respective hydraulic control lines.

2. A control valve device according to claim 1, wherein a rotary drive comprises the drive means.

3. A control valve device according to claim 1, wherein the drive means reciprocably drives the slide member via a threaded spindle, and wherein the slide member is non-rotatably mounted within the slide valve housing.

4. A control valve device according to claim 1, wherein the length of each annular groove and the length of each axial bore is at least equal to the distance through which the slide member is movable by the drive means.

5. A hydraulic control system for a mine roof support assembly, the hydraulic control system comprising a hydraulic control device and a plurality of hydraulic control valves, the hydraulic control valves being controlled by the hydraulic control device, and the hydraulic control device comprising a longitudinal slide valve having a slide member longitudinally reciprocable in a slide valve housing, and a drive for moving the slide member within the slide valve housing, wherein the slide member is provided with two axially-spaced axial bores, each axial bore opening into a respective pair of axially-spaced radial bores which terminate at the peripheral surface of the slide member, a first radial bore of each axial bore opening into a respective annular groove formed in the slide valve housing, and the second radial bore of each axial bore being connected to a respective group of control ports provided on the slide valve housing, the control ports of each group being axially spaced, and the control ports of each group being connected to the hydraulic control valves by respective hydraulic control lines.

6. A control system according to claim 5, further comprising an additional hydraulic control valve, a hydraulic pressure line and a hydraulic return line, the additional hydraulic control valve being connected between the hydraulic pressure and return lines and the longitudinal slide valve.

7. A control system according to claim 6, wherein the additional hydraulic control valve is an electromagnetically-operated hydraulic control valve.

8. A control system according to claim 6, wherein the additional hydraulic control valve is hydraulically connected to each annular groove of the slide valve housing.

9. A control system according to claim 6, wherein the additional hydraulic control valve is a 4/3 way hydraulic control valve.

10. A control system according to claim 5, wherein each of the hydraulic control valves is a double-acting control valve which is actuatable in opposite directions by means of respective control cylinders.

11. A control system according to claim 10, wherein the hydraulic control lines associated with one group of control ports are connected to the first control cylinders, and the hydraulic control lines associated with the other group of control ports are connected to the second control cylinders, whereby each hydraulic control valve can be extended by connecting the associated first control cylinder to the hydraulic pressure line and the associated second control cylinder to the hydraulic return line, and each hydraulic control valve can be retracted by connecting the associated first control cylinder to the hydraulic return line and the associated second control cylinder to the hydraulic pressure line.

12. A hydraulic control system for a mine roof support assembly, the hydraulic control system comprising a hydraulic control device and a plurality of hydraulic control valves which are controlled by the hydraulic control device, the hydraulic control device comprising a longitudinal slide valve having a slide member longitudinally reciprocable in a slide valve housing, and a drive for moving the slide member within the slide valve housing, wherein the slide member includes an axial bore, said axial bore opening into a respective pair of axially-spaced radial bores which terminate at the peripheral surface of the slide member, a first radial bore of said axial bore opening into an annular groove formed in the slide valve housing, and the second radial bore of said axial bore being connected to a group of control ports provided on the slide valve housing, the control ports of said group being axially spaced, and the control ports of said group being connected to the hydraulic control valves by respective hydraulic control lines.

13. A control system according to claim 12, wherein a rotary drive comprises the drive means.

14. A control system according to claim 12, wherein the drive means reciprocably drives the slide member via a threaded spindle, and wherein the slide member is non-rotatably mounted within the slide valve housing.

15. A control system according to claim 12, wherein the length of the annular groove and the length of the axial bore is at least equal to the distance through which the slide member is movable by the drive means.

16. A control system according to claim 12, further comprising an additional hydraulic control valve, a hydraulic pressure line and a hydraulic return line, the additional hydraulic control valve being connected between the hydraulic pressure and return lines and the longitudinal slide valve.

17. A control system according to claim 16, wherein the additional hydraulic control valve is an electromagnetically-operated hydraulic control valve.

18. A control system according to claim 16, wherein the additional hydraulic control valve is hydraulically connected to the annular groove of the slide valve housing.

19. A control system according to claim 16, wherein the additional hydraulic control valve is a 4/3 way hydraulic control valve.

20. A control system according to claim 12, wherein each of the hydraulic control valves is a double-acting control valve which is actuatable in opposite directions by means of respective control cylinders.

* * * * *